US009178280B2

(12) United States Patent
Liu et al.

(10) Patent No.: US 9,178,280 B2
(45) Date of Patent: Nov. 3, 2015

(54) LOOP ANTENNA

(71) Applicant: ASKEY COMPUTER CORP., New Taipei (TW)

(72) Inventors: Chien-Sheng Liu, Chiayi County (TW); Wei-Lu Hung, Taipei (TW); Sheng-Hsin Chang, Kaohsiung (TW)

(73) Assignee: ASKEY COMPUTER CORP., New Taipei (TW)

( * ) Notice: Subject to any disclaimer, the term of this patent is extended or adjusted under 35 U.S.C. 154(b) by 217 days.

(21) Appl. No.: 13/961,894

(22) Filed: Aug. 8, 2013

(65) Prior Publication Data

US 2014/0125547 A1 May 8, 2014

(30) Foreign Application Priority Data

Nov. 7, 2012 (TW) ..... 101141444 A

(51) Int. Cl.

| | |
|---|---|
| ***H01Q 7/00*** | (2006.01) |
| ***H01Q 1/24*** | (2006.01) |
| ***H01Q 9/04*** | (2006.01) |
| ***H01Q 5/364*** | (2015.01) |

(52) U.S. Cl.

CPC ..... *H01Q 7/005* (2013.01); *H01Q 1/243* (2013.01); *H01Q 5/364* (2015.01); *H01Q 9/0421* (2013.01)

(58) Field of Classification Search

CPC ..... H01Q 7/005; H01Q 5/364; H01Q 1/243
USPC ..... 343/866, 702
See application file for complete search history.

(56) References Cited

U.S. PATENT DOCUMENTS

| | | | | |
|---|---|---|---|---|
| 6,917,335 | B2 * | 7/2005 | Kadambi et al. | 343/700 MS |
| 7,696,935 | B2 * | 4/2010 | Qi et al. | 343/702 |
| 7,755,546 | B2 * | 7/2010 | Ishimiya | 343/702 |
| 8,654,021 | B2 * | 2/2014 | Brown et al. | 343/748 |

* cited by examiner

*Primary Examiner* — Hoang V Nguyen
(74) *Attorney, Agent, or Firm* — Jianq Chyun IP Office

(57) ABSTRACT

A loop antenna adapted for a communication device is provided. The loop antenna includes a feed, a ground, a circular loop, at least one first tuning element, and at least one second tuning element. The circular loop is connected to the feed and the ground. The first tuning element is extended from the circular loop and corresponds to a first frequency band. The second tuning element is extended from the circular loop and corresponds to a second frequency band. Bandwidths of the first frequency band and the second frequency band of the loop antenna are changed by adjusting the first tuning element and the second tuning element, respectively.

6 Claims, 4 Drawing Sheets

LOOP ANTENNA

CROSS-REFERENCE TO RELATED APPLICATION

This application claims the priority benefit of Taiwan application serial no. 101141444, filed on Nov. 7, 2012. The entirety of the above-mentioned patent application is hereby incorporated by reference herein and made a part of this specification.

BACKGROUND OF THE INVENTION

1. Field of the Invention

The invention relates to a loop antenna; more particularly, the invention relates to a loop antenna with an adjustable bandwidth.

2. Description of Related Art

Research and development of communication devices are often conducted according to the market demands, and different types of the communication devices are presented to the public step by step. For instance, since a wireless fidelity (Wi-Fi) function has already become indispensable for normal users, a new communication device featuring Wi-Fi is often presented at first; in a later stage, the same type of communication device that further supports global system for mobile communication (GSM) or long term evolution (LTE) may then be developed. In theory, when the device featuring Wi-Fi is designed, the space for placing antennas with low frequency bands (e.g., GSM or LTE) may be kept in advance, so as to save the time and costs on subsequent re-molding and re-design.

The space for placing antennas with low frequency bands may sometimes not be kept in some types of devices. In this case, it is rather difficult for a designer to design antennas. For instance, the space capable of placing an antenna may have other circuits or metal and is not completely available, and a printed circuit board with high-speed signal lines or any other metal devices may be extremely close to the antenna, e.g., the distance therebetween may be less than 5 mm. Under these circumstances, the types of antennas become crucial, and a loop antenna, for instance, is not apt to be affected by surroundings.

Generally, the length of the antenna is determined according to the minimum frequency required by the antenna. For instance, if the desired frequency is 824 MHz, the required wavelength is approximately 0.364 meters because the light velocity ($3\times10^8$ meters/seconds) is calculated by multiplying the frequency of light ($8.24\times10^8$ MHz) by the wavelength. Since the required length of the loop antenna is half the wavelength, i.e., 0.182 meters, the required length of the loop antenna in the limited space within the communication device needs to satisfy 0.182 meters. As a result, the loop antenna within the communication device is often designed to be bent or surround the insulation elements in the communication device, such that the loop antenna may occupy less space.

FIG. 1 is a schematic view illustrating a conventional loop antenna. With reference to FIG. 1, the conventional loop antenna 10 includes a feed 12, a ground 14, and a circular loop 16 that is connected to the feed 12 and the ground 14. After the sample loop antenna 10 is made, the circular loop 16 can be barely adjusted. Even though the bandwidth corresponding to the conventional loop antenna 10 is different from the originally designed bandwidth, it is rather difficult to rectify this deficiency.

SUMMARY OF THE INVENTION

The invention is directed to a loop antenna that may be fine tuned, such that the loop antenna is able to have the required bandwidth.

In an embodiment of the invention, a loop antenna adapted for a communication device is provided. The loop antenna includes a feed, a ground, a circular loop, at least one first tuning element, and at least one second tuning element. The circular loop is connected to the feed and the ground. The first tuning element is extended from the circular loop and corresponds to a first frequency band. The second tuning element is extended from the circular loop and corresponds to a second frequency band. Bandwidths of the first frequency band and the second frequency band of the loop antenna are changed by adjusting the first tuning element and the second tuning element, respectively.

According to an embodiment of the invention, the loop antenna is a circular antenna.

According to an embodiment of the invention, the bandwidth of the first frequency band substantially ranges from 824 MHz to 960 MHz.

According to an embodiment of the invention, the first frequency band includes a global system for mobile communication (GSM) 850/950.

According to an embodiment of the invention, the bandwidth of the second frequency band substantially ranges from 1710 MHz to 2170 MHz.

According to an embodiment of the invention, the second frequency band includes at least one of a digital communication system (DCS), a personal communication system (PCS), and a universal mobile telecommunication system (UMTS).

According to an embodiment of the invention, the first tuning element and the second tuning element include an electrical conductor, respectively.

According to an embodiment of the invention, the electrical conductor is a capacitor, an inductor, or copper foil.

According to an embodiment of the invention, the first tuning element and the second tuning element are located in the circular loop or extended out of the circular loop.

According to an embodiment of the invention, the communication device includes a mobile phone or a tablet computer.

In view of the above, during the research and development stage or the fine-tuning stage of the sample loop antenna made by a factory, the first frequency band or the second frequency band may not have the required bandwidth and should therefore be adjusted. In the loop antenna described herein, the locations of the first and second tuning elements are determined by observing regions of the circular loop where the first and second frequency bands are affected significantly. Compared to the circular loop which may not be modified after manufacture, the first tuning element or the second tuning element may be easily adjusted, such that engineers are able to test and adjust the loop antenna. When the first and second tuning elements are electrical conductors, such as copper foil or the like, the length and width of the copper foil may be adjusted to control resonance frequency bands, such that the loop antenna may have the desired bandwidth. When the first and second tuning elements are capacitors or inductors, the values of the charges of the capacitors or inductors may be changed to adjust the bandwidth. In addition, according to experimental results, the loop antenna described herein may be applied to a so-called five-band wireless communication system (GSM 850/900, DCS, PCS and UMTS).

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
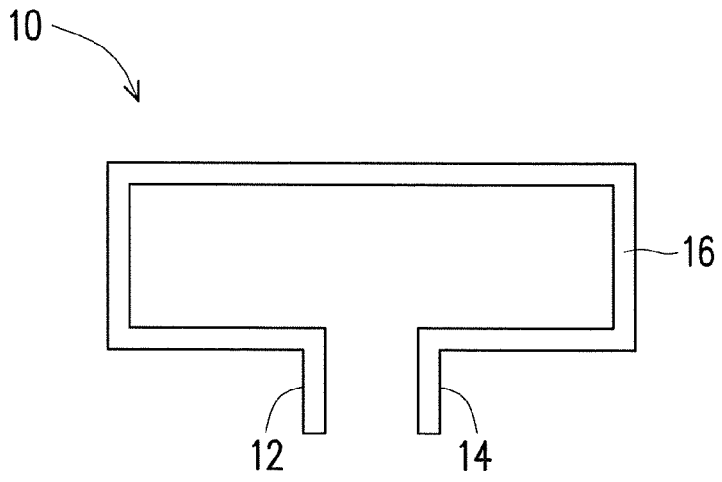
FIG. 1 is a schematic view illustrating a conventional loop antenna.
Figure 2:
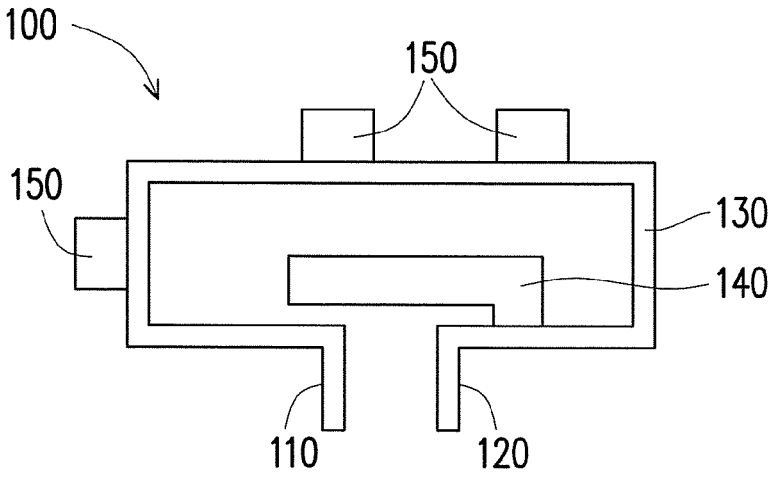
FIG. 2 is a schematic view illustrating a loop antenna according to an embodiment of the invention.

FIG. 2 is a schematic view illustrating a loop antenna according to an embodiment of the invention. With reference to FIG. 2, the loop antenna 100 described in the present embodiment is adapted for a communication device. The communication device includes but is not limited to a mobile phone or a tablet computer. The loop antenna 100 includes a feed 110, a ground 120, a circular loop 130, at least one first tuning element 140, and at least one second tuning element 150.

The circular loop 130 is connected to the feed 110 and the ground 120. The first tuning element 140 is extended from the circular loop 130 and corresponds to a first frequency band. The second tuning element 150 is extended from the circular loop 130 and corresponds to a second frequency band. Bandwidths of the first frequency band and the second frequency band of the loop antenna 100 are changed by adjusting the first tuning element 140 and the second tuning element 150, respectively.

In the present embodiment, the loop antenna 100 is a circular antenna, while the type of the loop antenna 100 is not limited herein, i.e., any antenna that includes the circular loop 130 falls within the scope of the invention. Besides, as shown in FIG. 2, the number of the first tuning element 140 is 1, the number of the second tuning element 150 is 3, whereas the actual number of the first tuning element 140 and the actual number of the second tuning element 150 may vary according to the required bandwidths of the first and second frequency bands. The locations of the first and second tuning elements 140 and 150 on the circular loop 130 are determined by observing the region of the circular loop 130 where the first and second frequency bands may be affected significantly. Note that the number and locations of the first and second tuning elements 140 and 150 are not limited to those shown in FIG. 2.

During the research and development stage or the fine-tuning stage of the antenna, the first frequency band or the second frequency band in the sample loop antenna 100 made by a factory may not have the required bandwidth and should therefore be adjusted. In the present embodiment, it is likely to measure regions of the circular loop 130 and determine the regions where the first and second frequency bands are affected significantly. The first tuning element 140 is then configured on the region where the first frequency band is affected drastically, and the second tuning element 150 is configured on the region where the second frequency band is affected drastically. The first tuning element 140 and the second tuning element 150 include an electrical conductor, respectively. In the present embodiment, the electrical conductors are copper foil with a relatively long length determined and preserved in advance. After the aforesaid loop antenna 100 is formed, the first and second frequency bands in the loop antenna 100 may be measured.

If the measured first frequency band or the measured second frequency band in the loop antenna 100 has a high frequency which should be lowered down, the first tuning element 140 or the second tuning element 150 which is the copper foil may be extended in length or broadened in width, so as to lower down the frequency range of the first frequency band or the second frequency band. On the contrary, if the measured first frequency band or the measured second frequency band in the loop antenna 100 has a low frequency which should be raised, the first tuning element 140 or the second tuning element 150 which is the copper foil may be shortened in length or narrowed in width, so as to raise the frequency range of the first frequency band or the second frequency band.

That is, in the present embodiment, the resonance points of the first and second frequency bands are determined not by changing the size of the circular loop 130 but by adjusting the length of the first tuning element 140 or the length of the second tuning element 150 in the loop antenna 100. Thereby, the designer may rapidly modify his or her design of the loop antenna 100 during the research and development stage and the fine-tuning stage, such that the possibility of fine-tuning the loop antenna 100 is significantly increased, and that it is rather easy to adjust the loop antenna 100. Moreover, in other embodiments of the invention, the electrical conductor may refer to a capacitor or an inductor, and the values of the charges of the capacitor or inductor may be changed, so as to adjust the bandwidths and the impedance matching of the first and second frequency bands.

Different communication devices may have different internal space that may accommodate the loop antenna. In the present embodiment, the first tuning element 140 is located in the circular loop 130, and the second tuning element 150 is extended out of the circular loop 130. However, the relative locations of the first and second tuning elements 140 and 150 and the circular loop 130 are not limited herein. Besides, the locations of the feed 110 and the ground 130 of the loop antenna 100, the width of the circular loop 130, the relative locations, the length, and the dimensions of the first and second tuning elements 140 and 150 and the circular loop 130 may vary in different communication devices. As long as the bandwidths of the first frequency band and the second frequency band of the loop antenna 100 may be changed by adjusting the first tuning element 140 and the second tuning element 150, the loop antenna 100 falls within the scope of the invention.

At present, the frequency bands of antenna which may be applied to mobile communication devices include GSM 850/900 (with the bandwidth ranging from 824 megahertz (MHz) to 960 MHz), DCS (with the bandwidth ranging from 1710 MHz to 1880 MHz), PCS (with the bandwidth ranging from 850 MHz to 1990 MHz), and UMTS (with the bandwidth ranging from 1920 MHz to 2170 MHz).

Figure 3:
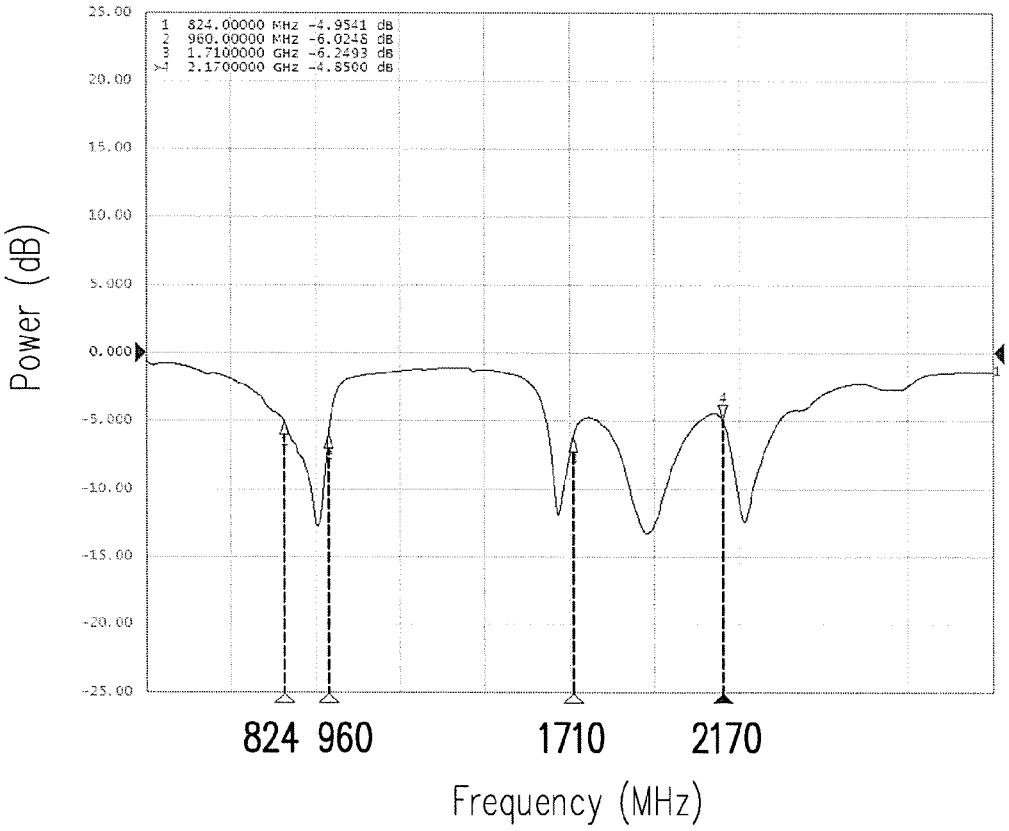
FIG. 3 shows properties of the loop antenna depicted in FIG. 2.

FIG. 3 shows properties of the loop antenna depicted in FIG. 2. With reference to FIG. 3, the horizontal axis stands for frequency in unit of MHz; the vertical axis stands for return loss in unit of decibel (dB). As shown in FIG. 3, in the loop antenna 100 described in the present embodiment, the bandwidth of the first frequency band substantially ranges from about 824 MHz to about 960 MHz; the bandwidth of the second frequency band substantially ranges from about 1710 MHz to about 2170 MHz.

Here, the first frequency band includes GSM 850/950. Table 1 shows the measured frequency-efficiency of the first frequency band in the loop antenna 100 depicted in FIG. 2. In the present embodiment, after the first frequency band in the loop antenna 100 is tested, the resultant test results are shown in Table 1. As indicated below, if the frequency of the first frequency band ranges from 824 MHz to 940 MHz, the corresponding efficiency approximately ranges from 45% to 64.9%. This evidences that the loop antenna 100 described herein has favorable efficiency at the first frequency band.

| | Frequency (MHz) | | | | | | | | | | |
|---|---|---|---|---|---|---|---|---|---|---|---|
| | 824 | 836 | 849 | 862 | 869 | 880 | 894 | 900 | 915 | 925 | 940 |
| Efficiency (%) | 53.8 | 54.9 | 56.4 | 57.2 | 57.6 | 58.9 | 60.4 | 61.6 | 64.9 | 61.4 | 45.0 |

The second frequency band includes at least one of DCS, PCS, and UMTS. Table 2 shows the measured frequency-efficiency of the second frequency band in the loop antenna 100 depicted in FIG. 2. In the present embodiment, after the second frequency band in the loop antenna 100 is tested, the resultant test results are shown in Table 2. As indicated below, if the frequency of the second frequency band ranges from 1710 MHz to 2170 MHz, the corresponding efficiency approximately ranges from 37.4% to 75.4%. This evidences that the loop antenna 100 described herein has favorable efficiency at the second frequency band.

| | Frequency (MHz) | | | | | | | | | | |
|---|---|---|---|---|---|---|---|---|---|---|---|
| | 1710 | 1730 | 1750 | 1770 | 1785 | 1805 | 1840 | 1850 | 1880 | 1910 | 1920 |
| Efficiency (%) | 54.8 | 48.3 | 47.4 | 48.7 | 50.7 | 51.5 | 58.4 | 61.9 | 67.5 | 70.9 | 71.8 |
| | Frequency (MHz) | | | | | | | | | | |
| | 1930 | 1950 | 1960 | 1980 | 1990 | 2010 | 2018 | 2025 | 2110 | 2140 | 2170 |
| Efficiency (%) | 71.4 | 73.2 | 75.4 | 70.2 | 66.9 | 66.1 | 65.2 | 63.1 | 45.5 | 37.4 | 38.5 |

According to said test results, the loop antenna 100 described in the present embodiment may be applied to a so-called five-band wireless communication system (GSM 850/900, DCS, PCS, and UMTS).

Figure 4:
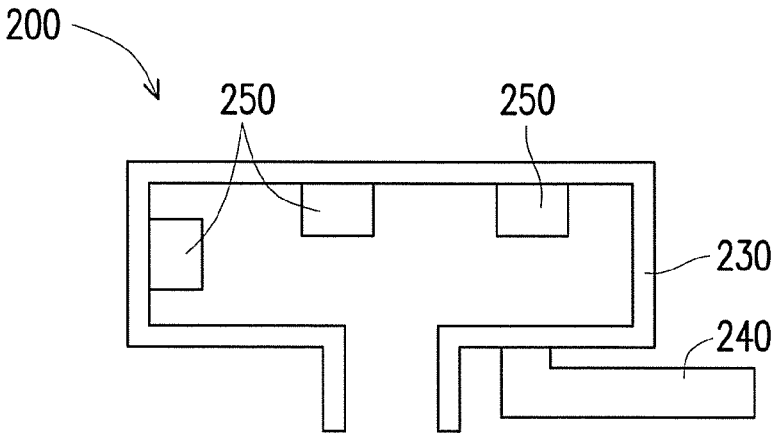
FIG. 4 is a schematic view illustrating a loop antenna according to another embodiment of the invention.

FIG. 4 is a schematic view illustrating a loop antenna according to another embodiment of the invention. With reference to FIG. 4, the difference between the loop antenna 200 depicted in FIG. 4 and the loop antenna 100 depicted in FIG. 2 mainly lies in that the first tuning element 240 in FIG. 4 is extended out of the circular loop 230, and the second tuning elements 250 are respectively located in the circular loop 230. The way to configure the first tuning element 240 and the second tuning elements 250 may vary according to the space within the communication device; in other embodiments of the invention, the first and second tuning elements 240 and 250 may be simultaneously located in the circular loop 230 or located on the outside of the circular loop 230. Alternatively, the second tuning elements 250 may be partially located in the circular loop 230 and partially located on the outside of the circular loop 230. The relative locations of the first and second tuning elements 240 and 250 and the circular loop 230 are not limited in the invention.

Figure 5A:
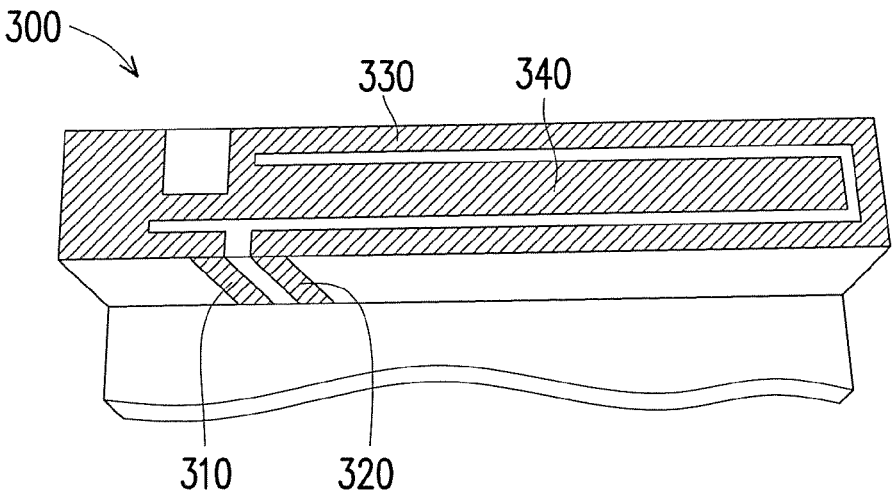
FIG. 5A to FIG. 5C are schematic views illustrating a loop antenna which is configured within a communication device and observed at different viewing angles according to still another embodiment of the invention.
Figure 5B:
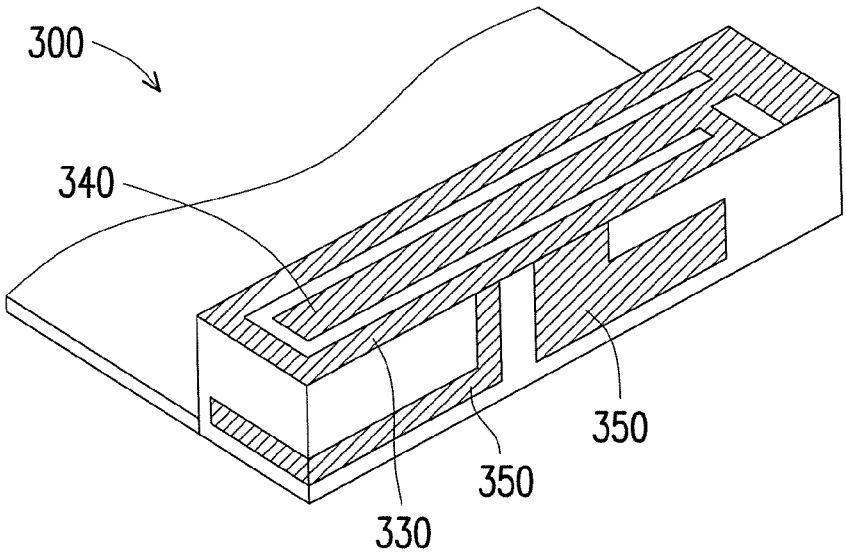
Figure 5C:
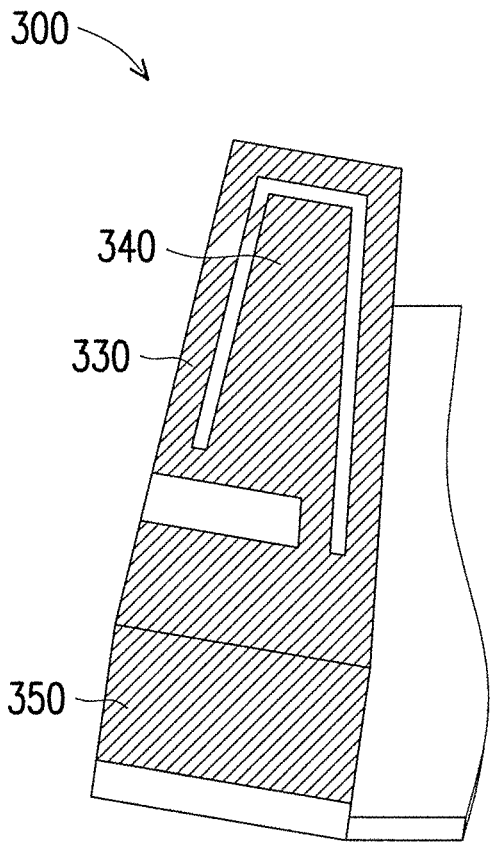

FIG. 5A to FIG. 5C are schematic views illustrating a loop antenna which is configured within a communication device and observed at different viewing angles according to still another embodiment of the invention. With reference to FIG. 5A to FIG. 5C, the loop antenna 300 is schematically configured in the communication device (e.g., a mobile phone). Since the communication device has limited internal space for accommodating the loop antenna 300, the loop antenna 300 is bent in compliance with the internal structure of the communication device and adhered to different planes. As shown in FIG. 5A, the circular loop 330 is connected to the feed 310 and the ground 320. The first tuning element 340 is extended from the circular loop 330. FIG. 5B and FIG. 5C illustrate the loop antenna 300 at another two different viewing angles, and the second tuning element 350 are extended from the circular loop 330 and adhered to other planes. FIG. 5A to FIG. 5C merely show one loop antenna that is configured within the communication device, and the way to configure the loop antenna in the communication device is not limited thereto.

To sum up, during the research and development stage or the fine-tuning stage of the sample loop antenna made by a factory, the first frequency band or the second frequency band may not have the required bandwidth and should therefore be adjusted. In the loop antenna described herein, the locations of the first and second tuning elements are determined by observing regions of the circular loop where the first and second frequency bands are affected significantly. Compared to the circular loop which may not be modified after manufacture, the first tuning element or the second tuning element may be easily adjusted, such that engineers are able to test and adjust the loop antenna. When the first and second tuning elements are electrical conductors, such as copper foil or the like, the length and width of the copper foil may be adjusted, such that the loop antenna may have the desired bandwidth. When the first and second tuning elements are capacitors or inductors, the values of the charges of the capacitors or inductors may be changed to adjust the bandwidth. In addition, according to experimental results, the loop antenna described herein may be applied to a so-called five-band wireless communication system (GSM 850/900, DCS, PCS, and UMTS).

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A loop antenna adapted for a communication device, the loop antenna comprising:

a feed;

a ground;

a circular loop connected to the feed and the ground;

at least one first tuning element extended from the circular loop, the at least one first tuning element corresponding to a first frequency band; and at least one second tuning element extended from the circular loop, the at least one second tuning element corresponding to a second frequency band, wherein the at least one first tuning element and the at least one second tuning element respectively comprise an electrical conductor, the electrical conductor is a capacitor, an inductor, or copper foil, wherein bandwidths of the first frequency band and the second frequency band of the loop antenna are changed by adjusting lengths, widths, values of charges of the capacitors or inductors of the at least one first tuning element and the at least one second tuning element, respectively, and the at least one first tuning element and the at least one second tuning element are located in the circular loop.

2. The loop antenna as recited in claim 1, wherein the bandwidth of the first frequency band substantially ranges from 824 MHz to 960 MHz.

3. The loop antenna as recited in claim 1, wherein the first frequency band comprises a global system for mobile communication 850/950.

4. The loop antenna as recited in claim 1, wherein the bandwidth of the second frequency band substantially ranges from 1710 MHz to 2170 MHz.

5. The loop antenna as recited in claim 1, wherein the second frequency band comprises at least one of a digital communication system, a personal communication system, and a universal mobile telecommunication system.

6. The loop antenna as recited in claim 1, wherein the communication device comprises a mobile phone or a tablet computer.

* * * * *